US005205012A

United States Patent [19]

Coley

[11] Patent Number: 5,205,012

[45] Date of Patent: Apr. 27, 1993

[54] CLEANING TOOL

[76] Inventor: Ella B. Coley, 202 Grotto Blvd., San Antonio, Tex. 78216

[21] Appl. No.: 823,979

[22] Filed: Jan. 22, 1992

[51] Int. Cl.[5] ..... A47L 13/46

[52] U.S. Cl. ..... 15/210.1; 15/147.1; 15/228; 15/231; 15/247

[58] Field of Search ..... 15/231, 232, 228, 210 R, 15/209 R, 209 E, 220 R, 247

[56] References Cited

U.S. PATENT DOCUMENTS

| | | | |
|---|---|---|---|
| 719,596 | 2/1903 | Lauterbach . | |
| 1,291,131 | 1/1919 | Radel | 15/147.2 |
| 1,755,881 | 4/1930 | Kilbride | 15/231 |
| 2,100,477 | 11/1937 | Fritz et al. . | |
| 2,384,178 | 9/1945 | Kincaid . | |
| 2,718,653 | 9/1955 | Delsener | 15/231 |
| 2,719,315 | 10/1955 | Sheehan | 15/210 R |
| 2,736,913 | 3/1956 | Mirth | 15/231 |
| 2,740,150 | 11/1956 | Wilding . | |
| 2,895,153 | 7/1959 | Lowe | 15/232 |
| 2,916,759 | 12/1959 | Smith | 15/231 |
| 3,056,989 | 10/1962 | Murphy | 15/231 |
| 3,099,855 | 8/1963 | Nash | 15/231 |
| 3,421,171 | 1/1969 | Tsuruzawa | 15/231 |
| 3,571,837 | 3/1971 | Weaver . | |
| 3,877,103 | 4/1975 | Nash | 15/147.1 |
| 4,184,221 | 1/1989 | Edwards | 15/114 |
| 5,012,544 | 5/1991 | Verry . | |

FOREIGN PATENT DOCUMENTS

| | | | |
|---|---|---|---|
| 781632 | 2/1935 | France | 15/231 |
| 798408 | 5/1936 | France | 15/228 |
| 214576 | 8/1941 | Switzerland | 15/247 |

*Primary Examiner*—Harvey C. Hornsby
*Assistant Examiner*—Randall E. Chin

[57] ABSTRACT

A cleaning tool having a cloth support element secured to an elongated handle. Any conventional piece of cloth, such as toweling, may be snugly applied across one face of the cloth support element by detachable securement of the peripheral portions of the cloth to the support element without the employment of tools.

2 Claims, 5 Drawing Sheets

CLEANING TOOL

BACKGROUND OF THE INVENTION

1. FIELD OF THE INVENTION

The invention relates to a cleaning tool which may be utilized for washing or dusting body surfaces or article surfaces that are not readily accessible for manual contact, such as the back of a body, the central portions of an automobile windshield, heating and cooling grills, high windows, etc..

2. SUMMARY OF THE PRIOR ART

A large number of cleaning tools have heretofore been disclosed in the prior art, and particularly tools for effecting the washing or dusting of manually inaccessible areas. No one can properly wash their own back, and obese people have great difficulty in achieving the washing of their lower extremities. Moreover, there are many articles that require periodical washing, dusting or waxing, such as the central portions of automotive windshields or body of a car, heating and/or cooling registers, refrigerator coils, tall windows and the like. All of such tools are generally sold with a cloth element attached thereto which element actually comes in contact with the surface to be washed or dusted or waxed.

In every household, there is a supply of articles commonly referred to as wash cloths or dish cloths which are generally of rectangular shape. The prior art has not provided a cleaning tool to which one of these ordinary wash cloths may be conveniently detachably secured for cleaning purposes and then removed to permit the washing of the soiled wash cloth. While the problem of cleaning manually inaccessible surfaces has existed since the beginning of history, an effective cleaning tool which is economical both to purchase and to maintain has not been heretofore available.

SUMMARY OF THE INVENTION

This invention provides a cleaning tool comprising a support element for an ordinary piece of cloth, such as a wash cloth or a dish rag, to which is rigidly secured a radially extending handle having its unsecured end formed as a manually graspable handle. The wash cloth or similar piece of toweling is normally of rectangular shape and has a total area substantially exceeding that of the support element. Thus, when the medial portions of the piece of toweling are placed in abutment with the substantially flat face of the washing tool, there will be a substantial overlap of the peripheral portions of the piece of toweling relative to the periphery of the support element. In accordance with this invention, the piece of toweling may be secured in one embodiment by providing a recess in the face of the support element opposite the substantially flat face, which is dimensioned to snugly receive all four corners of the piece of toweling and thus pull the piece of toweling into tight engagement with the support element. Obviously, the piece of toweling may be readily removed from the support element when the cleaning task is accomplished and it is desired to wash the soiled piece of cloth.

In accordance with another embodiment of the invention, the peripheral edge of the support element is provided with an outwardly projecting surface defining a retaining rib. The overlapping portions of the piece of toweling are then secured under the retaining rib through the simple application of an elastic band. In both modifications of the invention, it is not necessary for the user to purchase a piece of toweling with the support element inasmuch as the typical purchaser already has an adequate supply of small rectangular pieces of toweling in the form of wash cloths or dish cloths. When soiled, these pieces of toweling can be readily removed from the support element and placed in the family washer to be cleaned for reuse. Thus, a cleaning tool for inaccessible areas is provided with minimum cost and maximum convenience.

Further advantages of the invention will be readily apparent those skilled in the art from the following detailed description, taken in conjunction with the annexed sheets of drawings, on which are shown two preferred embodiments of the invention.

DESCRIPTION OF PREFERRED EMBODIMENTS

Figure 1:
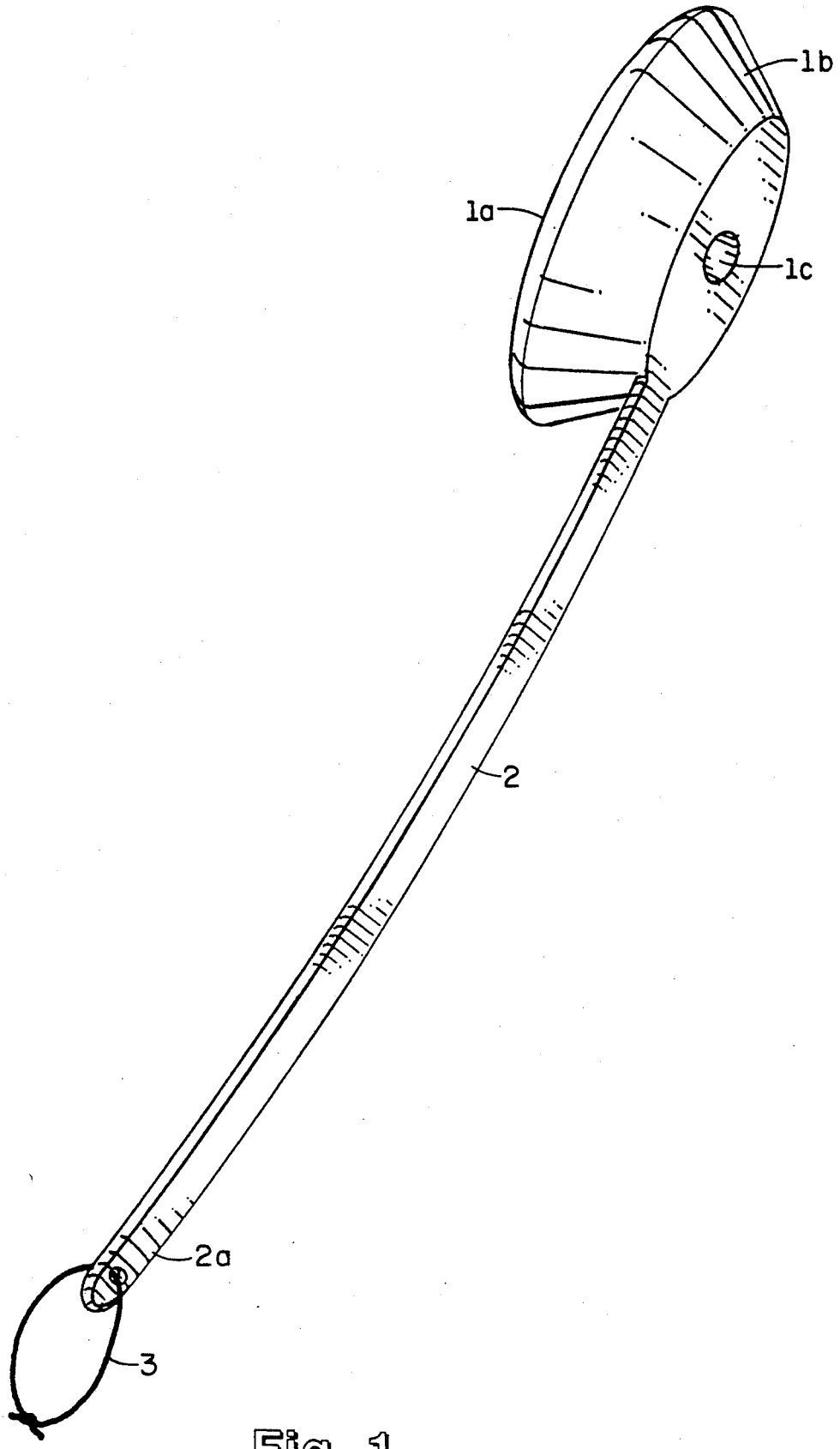
FIG. 1 is a perspective view of a support element for a cleaning tool embodying this invention.

Referring to FIG. 1, a cloth support element for a cleaning tool embodying this invention is shown as having an arcuate peripheral configuration. While the configuration can be either circular or oval, the term "arcuate peripheral configuration" is intended to include both configurations. The cloth support element 1 has a substantially flat front face 1*a* which may, if desired, be slightly convex. On the other side of support element 1, an axially extending protuberance 1*b* is provided having a rear face 1*d* and central cylindrical recess 1*c* formed therein.

Figure 2:
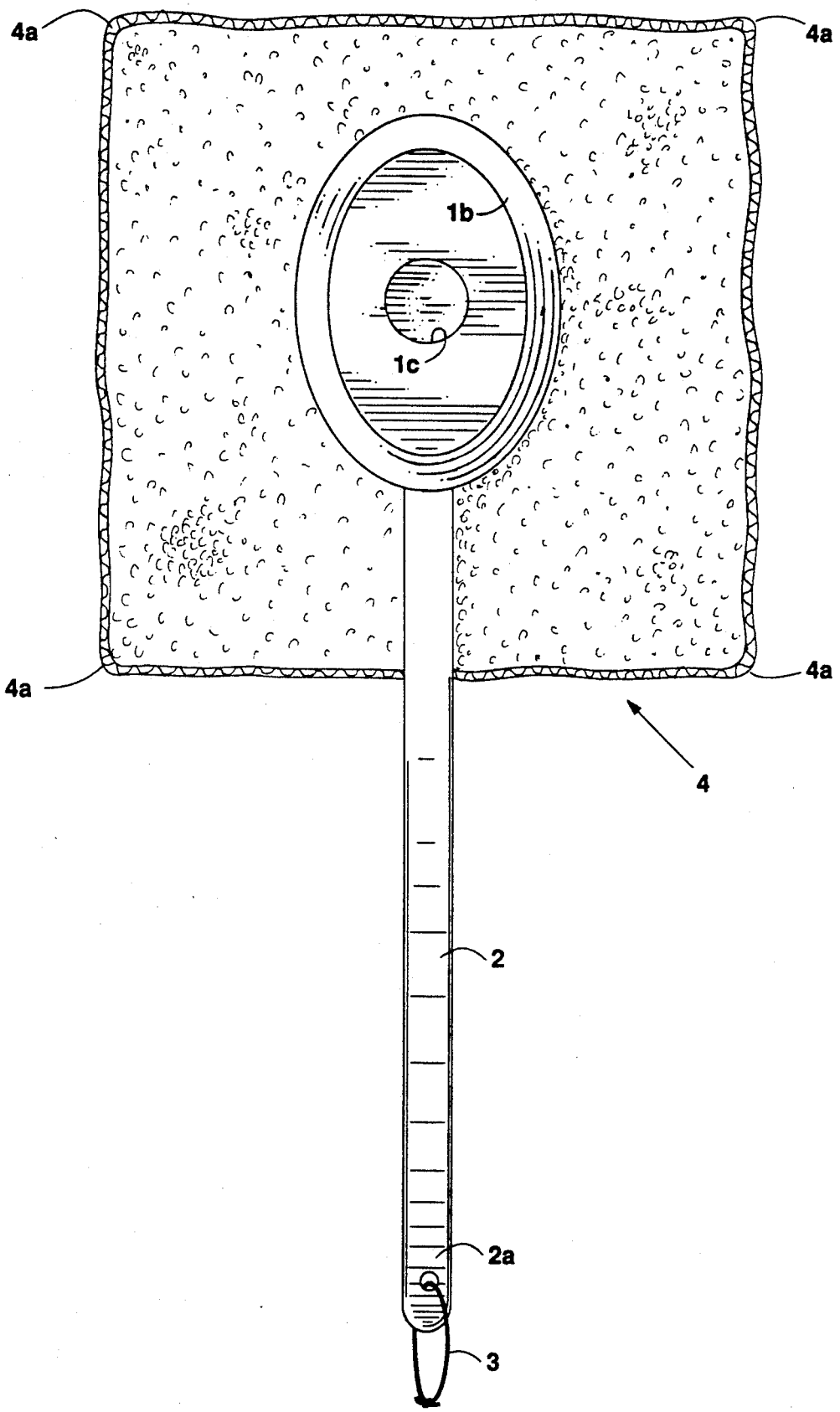
FIG. 2 is a rear elevational view of the support element of FIG. 1 shown in positioned relationship with respect to a wash cloth prior to assemblage of the wash cloth to the support element.

A handle is rigidly secured to support element 1 as by being formed integrally with support element 1, or being glued or welded to the support element 1, depending upon the material employed for these elements. The unsecured end 2*a* of handle 2 is shaped to be conveniently graspable by the hand of the user and incorporates a hole which receives a loop 3 by which the tool may be suspended from any wall hook. As best shown in FIG. 2, a wash cloth 4 is provided, preferably formed of toweling, which is of rectangular configuration and defines four corners 4*a*. As a practical matter, the wash cloth 4 could be polygonal configuration of 4, 5, or 6 sides and thus defining an equal number of corners. In any event, the total area of the wash cloth 4 substantially exceeds the area of the face 1*a* of the support element as shown in FIG. 2.

Figure 3:
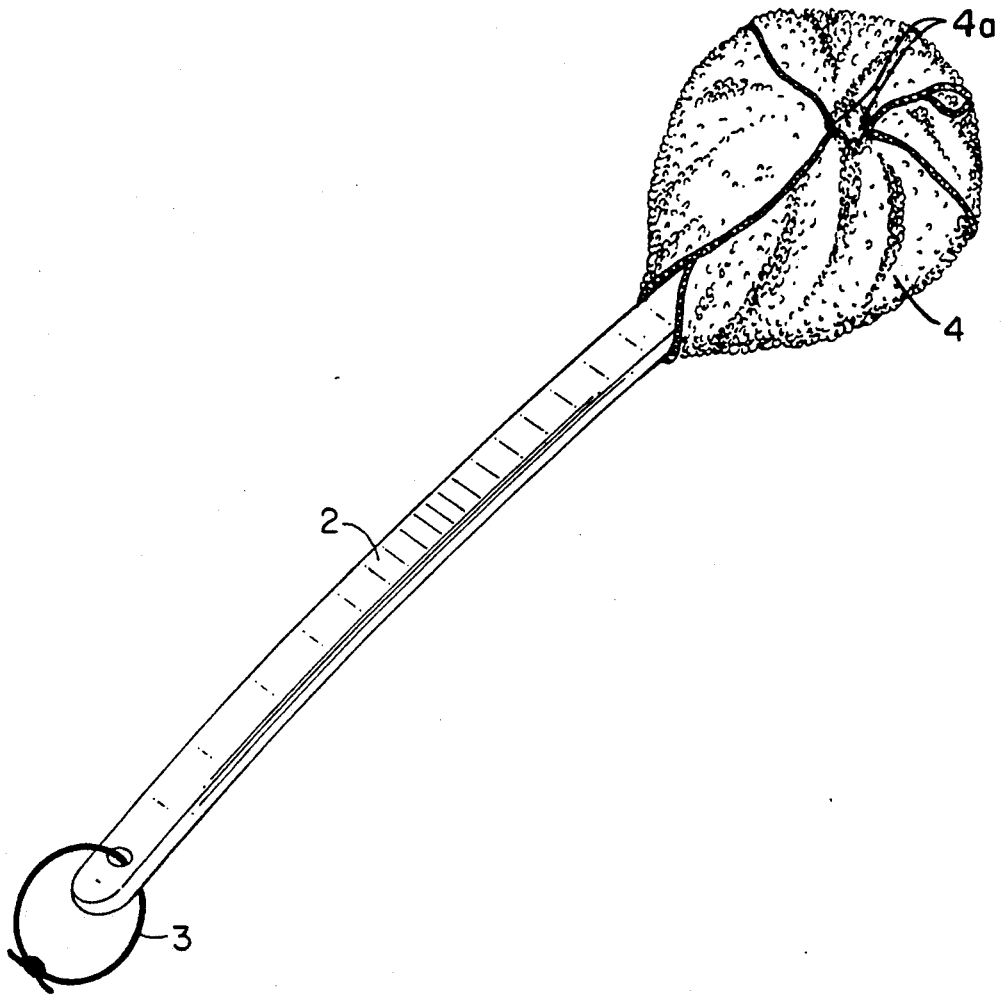
FIG. 3 is a perspective view illustrating the assemblage of the wash cloth to the support element.
Figure 4:
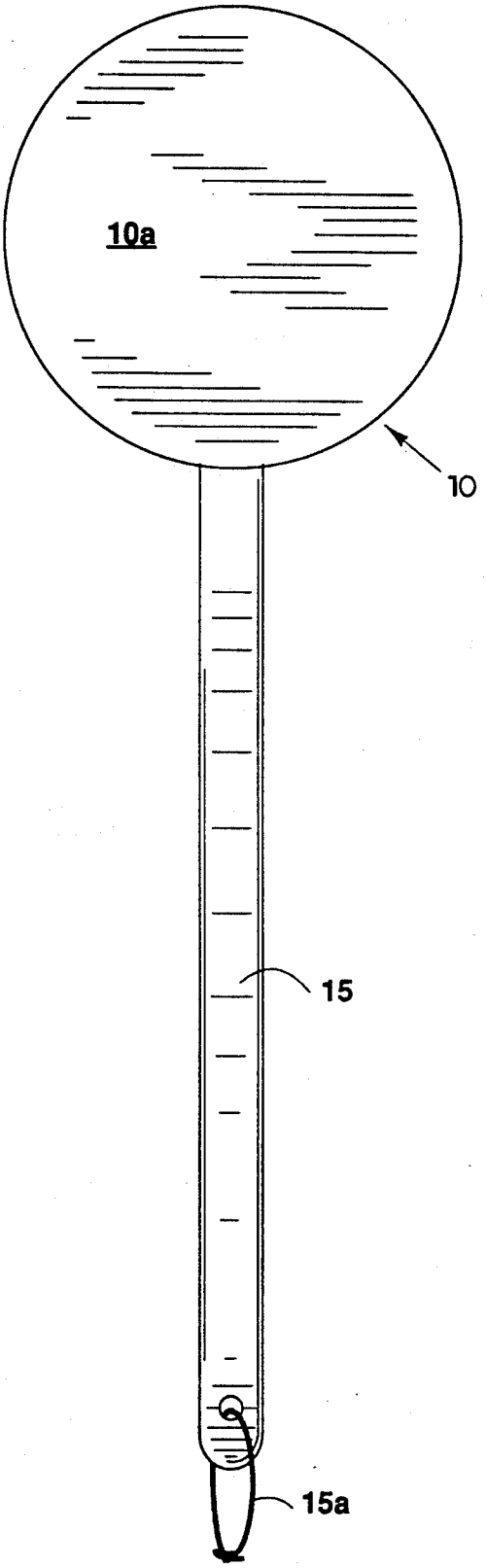
FIG. 4 is a rear elevational view of a modified support element embodying this invention.
Figure 5:
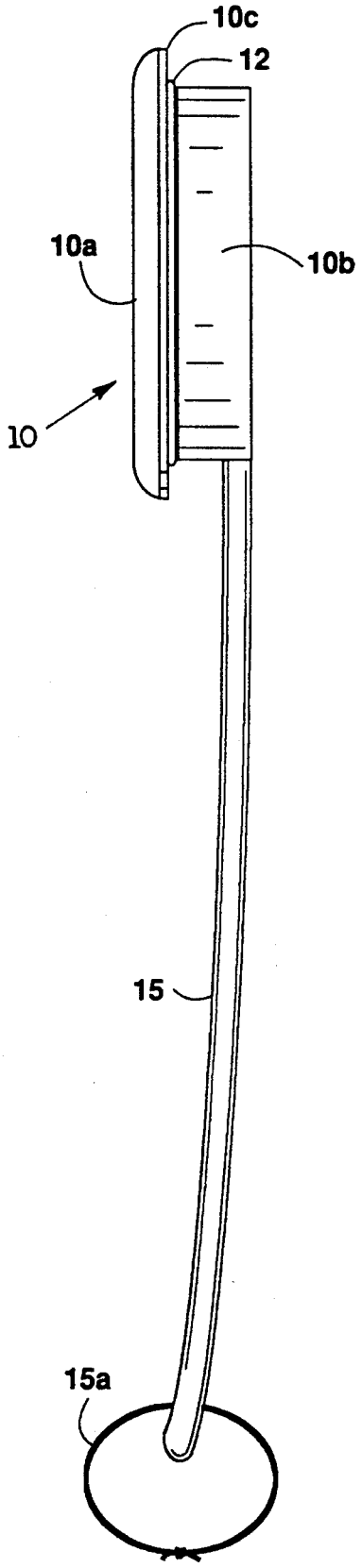
FIG. 5 is a side elevational view of FIG. 4.
Figure 6:
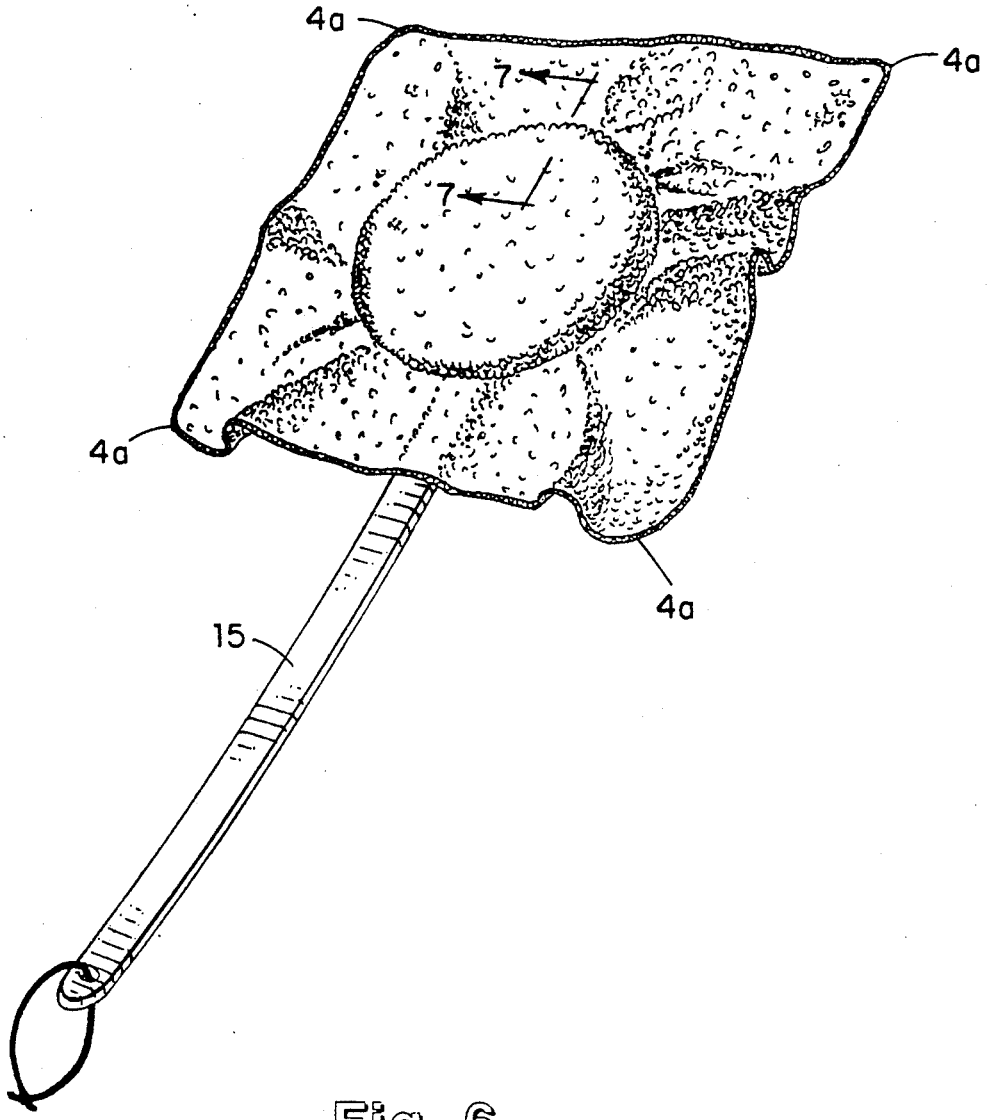
FIG. 6 is a perspective view illustrating the positioning of a wash cloth with respect to the support element of FIG. 4.
Figure 7:
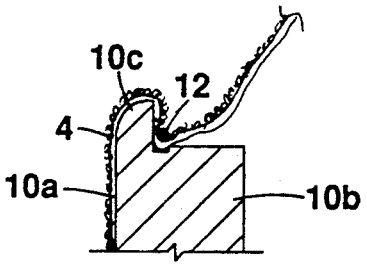
FIG. 7 is a partial sectional view taken on the plane 7—7 of FIG. 6.

The support element 1 is positioned relative to the wash cloth 4 as shown in FIG. 3 and the corners of the wash cloth are all stuffed within the cylindrical recess 1c, thereby snugly retaining the wash cloth 4 in assembled relationship to the support element 1.

The cleaning tool is then ready for use, and, after use, the wash cloth 4 may be conveniently removed from the support element 1 and washed for its next usage.

Referring now to FIGS. 4–7, there is shown a modified form of this invention wherein the support element 10 is of circular configuration and has a substantially flat wash cloth engaging surface 10a constituting one face thereof. As previously mentioned, the configuration of the supporting element 10 may be either circular or oval and hence it is best defined by the term "arcuate peripheral configuration". The peripheral wall 10b of the support element 10 is of reduced diameter and defines a radially projecting shoulder 10b.

When the support element 10 is positioned adjacent the medial portions of the wash cloth 4, the peripheral portions of the wash cloth substantially overlap the periphery of the support element 10 and hence such peripheral portions may be folded into overlapping relationship to the shoulder 10b. An elastic band 12 is then applied around the wash cloth and fits snugly beneath the shoulder 10c, thus securing the wash cloth 4 to the support element 10. As in the previous modification, the support element 10 is provided with an elongated handle 15 and a ring 15a for storage purposes.

The second modification has the advantage of not requiring a polygonal configuration of the cloth to provide corners for tucking into the recess 1c of the first modification.

Those skilled in the art will recognize that the basic principle of this invention lies in the convenient detachable securement of a conventional wash cloth or dish cloth to a support element that requires no tools. The reason for preferably employing an arcuate peripheral configuration for the cloth support element is to avoid the creation of wrinkles in the working surface of the wash cloth which lies in abutment with the substantially flat or slightly convex surface of the cloth support element.

Other configurations could obviously be employed to take advantage of the convenient detachable securement of the wash cloth to the support elements by either the two embodiments of the invention heretofore described.

What is claimed and desired to be secured by Letters Patent is:

1. Apparatus for cleaning surfaces not readily accessible to manual contact comprising:

a cloth support element having a substantially flat face bounded by a selected arcuate wall extending upwardly from the periphery of said cloth support element flat face, said arcuate wall having an opposed face opposite said flat face, an elongated handle secured to said arcuate configured wall and extending laterally from said opposed face and having its unsecured end shaped for convenient manual grasping;

a polygonal piece of cloth having an area in excess of said substantially flat face of said support element, whereby peripheral portions of said piece of cloth extend beyond said periphery of said support element when a central portion of said piece of cloth is positioned in abutment with said substantially flat face of said support element; and means for detachably securing said peripheral portions of said piece of cloth to said support element said means being only one recess formed in the center of said opposed face of said support element; said recess being dimensioned to snugly receive said peripheral portions of said piece of cloth in inserted relation thereto to detachably secure said piece of cloth to said support element.

2. The apparatus of claim 1 wherein the peripheral surface of said support element defines an outwardly projecting shoulder that is overlapped by the peripheral portions of said piece of cloth when the central portions of said piece of cloth is placed in abutment with the central portion of said substantially flat face of said support element; and an elastic band surrounding said overlapping portions of said cloth to secure said overlapping portions beneath said outwardly projecting shoulder.

* * * * *